US009212329B2

(12) United States Patent
Olliges

(10) Patent No.: US 9,212,329 B2
(45) **Date of Patent: *Dec. 15, 2015**

(54) USE OF HEXYLENE GLYCOL FUEL ADDITIVE CONTAINING BORIC OXIDE

(76) Inventor: William E. Olliges, Palm City, FL (US)

( * ) Notice: Subject to any disclaimer, the term of this patent is extended or adjusted under 35 U.S.C. 154(b) by 752 days.

This patent is subject to a terminal disclaimer.

(21) Appl. No.: 13/421,134

(22) Filed: Mar. 15, 2012

(65) Prior Publication Data

US 2013/0239463 A1 Sep. 19, 2013

(51) Int. Cl.

| | |
|---|---|
| ***C10L 1/18*** | (2006.01) |
| ***C10L 1/19*** | (2006.01) |
| ***C10L 1/30*** | (2006.01) |
| ***C10L 1/182*** | (2006.01) |
| ***C10L 1/10*** | (2006.01) |
| ***C10L 1/12*** | (2006.01) |
| ***C10L 10/08*** | (2006.01) |
| *C10L 1/16* | (2006.01) |
| *C10L 10/04* | (2006.01) |

(52) U.S. Cl.

CPC ..... *C10L 1/1826* (2013.01); *C10L 1/10* (2013.01); *C10L 1/1291* (2013.01); *C10L 10/08* (2013.01); *C10L 1/1616* (2013.01); *C10L 1/1641* (2013.01); *C10L 10/04* (2013.01); *C10L 2200/0423* (2013.01); *C10L 2200/0446* (2013.01); *C10L 2230/22* (2013.01); *C10L 2270/02* (2013.01)

(58) Field of Classification Search

CPC ..... C10L 1/12; C10L 1/182; C10L 1/303; C10L 1/30; C10L 1/306; C10L 1/23; C10L 1/103; C10L 1/14; C10L 1/1852; C10L 1/19; C10L 1/232; C10L 1/233; C10L 1/2493; C10L 1/301; C10M 139/00; C10M 133/38; C10M 133/44; C10M 133/48; C10M 133/58; C10M 2205/022; C10M 2205/026; C10M 2205/06; C10M 2205/14; C10M 2205/22; C10M 2207/026; C10M 2207/027; C10M 2207/028; C10M 2207/144; C10M 2207/146; C10M 2207/16; C10M 2207/262; C10M 2207/289; C10M 2209/084; C10M 2209/086; C10M 2209/112; C10M 2215/04; C10M 2215/065; C10M 2215/12; C10M 2215/221; C10M 2215/225; C10M 2215/226; C10M 2215/26; C10M 2215/30

USPC ..... 44/309, 318, 319

See application file for complete search history.

(56) References Cited

U.S. PATENT DOCUMENTS

| | | | | |
|---|---|---|---|---|
| 2,741,548 | A * | 4/1956 | Darling et al. | 44/319 |
| 2,848,312 | A * | 8/1958 | Liao | 44/319 |
| 2,931,714 | A * | 4/1960 | De Gray | 44/319 |
| 4,753,661 | A * | 6/1988 | Nelson et al. | 44/309 |
| 5,501,714 | A * | 3/1996 | Valentine et al. | 44/358 |
| 5,652,201 | A * | 7/1997 | Papay et al. | 508/228 |
| 6,368,369 | B1 | 4/2002 | Sanduja et al. | |
| 6,645,262 | B1 | 11/2003 | Sanduja et al. | |
| 7,419,515 | B2 | 9/2008 | Olliges | |
| 7,494,959 | B2 | 2/2009 | Olliges | |
| 7,598,210 | B2 | 10/2009 | Olliges | |
| 7,972,393 | B2 | 7/2011 | Olliges | |
| 2006/0100111 | A1* | 5/2006 | Selin | 508/156 |
| 2007/0021310 | A1 | 1/2007 | Olliges et al. | |
| 2007/0033862 | A1 | 2/2007 | Olliges | |
| 2007/0037714 | A1 | 2/2007 | Olliges | |
| 2008/0200356 | A1 | 8/2008 | Olliges | |
| 2011/0015104 | A1 | 1/2011 | Olliges | |
| 2011/0036262 | A1 | 2/2011 | Olliges et al. | |

FOREIGN PATENT DOCUMENTS

| | | |
|---|---|---|
| WO | WO0153435 | 7/2001 |

* cited by examiner

*Primary Examiner* — James Goloboy
*Assistant Examiner* — Latosha Hines
(74) *Attorney, Agent, or Firm* — McHale & Slavin P.A.

(57) ABSTRACT

The present invention relates to a fuel additive formulation applied to internal combustion engines formulated to reduce friction, corrosion, and wear in the internal combustion engines. The fuel additive in accordance with the present invention is a formulation of hexylene glycol and boric oxide. Reduction of engine wear and degradation due to reduction of friction and deposit formation is expected to result in increased engine efficiency, extension of engine life, and reduction in repair and maintenance costs.

12 Claims, No Drawings

USE OF HEXYLENE GLYCOL FUEL ADDITIVE CONTAINING BORIC OXIDE

CROSS REFERENCE TO RELATED APPLICATIONS

The present invention is related to U.S. Patent Application entitled, "HEXYLENE GLYCOL FUEL ADDITIVE CONTAINING BORIC ACID FOR INHIBITING PHASE SEPARATION AND CORROSION IN ETHANOL BLENDED FUELS", filed on Mar. 15, 2012, and "USE OF HEXYLENE GLYCOL ADDITIVE CONTAINING BORIC ACID FOR REDUCING FRICTION AND CORROSION IN INTERNAL COMBUSTION ENGINE CRANKCASES", filed on Mar. 15, 2012.

FIELD OF THE INVENTION

The present invention relates to fuel compositions, and more particularly a novel fuel additive and/or engine lubricant that reduces friction, corrosion and wear in internal combustion engines.

Petroleum-based fuel prices in the United Sates continue to rise, causing economical pain to both businesses and consumers. Several reasons have been cited for the increasingly high prices seen at the gas pump. The United States continues to be one of the world's largest users of petroleum-based fuel. It is estimated the U.S. uses 18-20 million barrels of crude oil a day. As other countries such as China and India become more industrialized, they compete for oil, resulting in increases in the price of gas. Over the past several decades, the U.S. has steadily decreased its domestic production, creating increased dependency on foreign oil sources and fluctuating prices which are not always controllable. Exploring and drilling for new sources of domestic oil may be a mechanism to reduce the country's dependence on foreign oil. However, environmental concerns regarding the use of fossil fuels, i.e. increased levels of carbon dioxide emissions believed to contribute to the global warming phenomenon, have contributed to increased efforts for the development of alternative petroleum-based fuel sources.

Energy portfolios of the United States, as well as other industrialized nations, must be adapted to account for increased energy costs resulting from increased competition for limited resources as well as demand for cleaner fuels. Ethanol, an alcohol based, high octane renewable fuel made through fermentation and distillation of starch crops such as corn, has become an important part of the Untied States' energy portfolio. Ethanol provides an alternative fuel source which helps reduce dependency on foreign oil and reduces greenhouse emissions. It is estimated that greater than 80% of all retail gas stations across the United States use EBFs. Most commonly used in commercial settings is E10, a blend of 10% ethanol and 90% gasoline, or E85, a blend of 85% ethanol and 15% gasoline.

While the use of EBFs appear to provide a much needed alternative fuel source, acceptance of EBFs have not gained critical support because of several problems associated with their use. Additionally, means to increase the efficiency of vehicles using traditional as well as non-traditional fuel sources are needed to insure that such vehicles are running as efficiently as possible. Many fuel additives and engine oils have been developed to provide such mechanisms. Engine lubricants and fuel additives containing boric acid or boric oxide have been used to provide a means for improving lubricity in order to increase engine efficiency for years. While the use of such materials has shown promise, engine oils or lubricants developed form dispersions and/or emulsions as the boric acid or boric oxide is not easily or fully dissolved and tends to separate. Use of a nanotechnology to decease the size of the boric acid/boric oxide particles have improved the separation problem, however, such techniques are time consuming, expensive, and still suffers from the possibility of particle separation.

Therefore, what is needed in the art is a fuel additive and/or engine lubricant formulation applied to fuel sources or internal combustion engines which is cheap and easy to produce, forms a solution to prevent particle separation, and is formulated to reduce friction, corrosion, and wear in the internal combustion engines.

DESCRIPTION OF THE PRIOR ART

Use of boric acid and/or boric oxide in fuels and as engine lubricants is known in the art. For example, U.S. Pat. No. 7,972,393 describes a multiphase distillate fuel composition. The composition includes an emulsion comprising a first phase comprising a diesel fuel, a second phase comprising glycerol and boric acid, and a surfactant.

U.S. Pat. No. 7,598,210 describes a lubricant composition for high temperature application. The lubricant contains a desirable combination of high temperature and oxidative stability. The lubricant composition includes a neopolyol ester, boron nitride powder, and a linker/surfactant.

U.S. Pat. No. 7,494,959 describes stable boric acid-containing lubricant compositions which are described as being capable of increasing the efficiency and performance of engines and other machines. The multiphase lubricant compositions are formed of an emulsion containing (a) a first phase comprised of the lubricant, (b) a second phase containing boric acid and a liquid, such as an organic liquid, that is a solvent for boric acid, but immiscible in the first phase, and (c) a surfactant. The liquid is described as being an organic liquid, such as a lower alkyl polyol, preferably glycerol, ethyl acetate, acetone, and alcohols such as methanol, ethanol, 1-propanol, 2-methyl-1-propanol, and 3-methyl-1-butanol or an inorganic liquid, such as glacial acetic acid or water, with glycerol being preferred.

U.S. Pat. No. 7,419,515 describes a multiphase distillate fuel composition comprising an emulsion containing a first phase comprised of a distillate fuel, a second phase, the second phase comprised of boric acid and an organic liquid that is a solvent for boric acid, but immiscible in the first phase, and a surfactant.

U.S. Pat. No. 6,645,262 describes liquid hydrocarbon fuel concentrates, including low sulfur liquid hydrocarbon fuel concentrates containing at least 5,000 ppm boric acid suspended in the liquid hydrocarbon fuel. Also disclosed are liquid hydrocarbon fuel compositions formed by diluting the concentrate to form compositions containing only from about 10 ppm to about 50,000 ppm boric acid as well as liquid hydrocarbon fuel compositions formed of a reaction product of boric acid having a particle size of about 65 microns or less, associated with a liquid hydrocarbon fuel having a monomer or prepolymer chemically grafted thereon.

U.S. Pat. No. 6,368,369 describes liquid hydrocarbon fuel concentrates containing from about 50,000 ppm to about 250,000 ppm particulate boric acid, based on the total weight of the concentrate, suspended in a liquid hydrocarbon fuel. The liquid hydrocarbon fuel is described as containing less than 500 ppm or less than 300 ppm sulfur, or even substantially no sulfur.

United States Patent Application 2011/0036262 describes structural coating comprising a liquid carrier, a borate-based additive, and a dynamic stabilization material. The borate-based additive is described as providing corrosion protection through electrochemical binding of active surface corrosive sites, lubrication enhancement through the creation and re-supply to a surface where friction contact occasionally occurs of a weak slip lane crystalline material which may be a locally formed product utilizing local atmospheric humidity, and a material for reaction with an initiator to provide for freezing point depression during coating application. The dynamic stabilization material creates a balance of stabilized material for supply of corrosion protection product, lubrication reduction product, and freezing point depression product.

United States Patent Application 2011/0015104 describes a composition including a lubricant comprising at least one of a hydrocarbon oil or grease, a surfactant, an ester of adipic acid, and a suspension of boric acid.

United States Patent Application 2007/0021310 describes structural coating comprising a polymeric resin, a borate-based additive, and a dynamic stabilization material. The borate-based additive is described as providing corrosion protection through electrochemical binding of active surface corrosive sites, lubrication enhancement through the creation and re-supply to a surface where friction contact occasionally occurs of a weak slip lane crystalline material which may be a locally formed product utilizing local atmospheric humidity, and a material for reaction with an initiator to provide for freezing point depression during coating application.

SUMMARY OF THE INVENTION

The present invention relates to a fuel additive and/or engine lubricant formulation applied to internal combustion engines formulated to reduce friction, corrosion, and wear in the internal combustion engines. Reduction of engine wear and degradation due to friction and deposit formation results in 1) improved engine efficiency, 2) extension of engine life, and 3) reduction of repair and maintenance costs. The fuel additive in accordance with the present invention is a formulation of hexylene glycol and boric oxide. The hexylene glycol acts as a solvent for the boric oxide to provide a homogenous solution.

Accordingly, it is an objective of the present invention to provide a fuel additive formulation.

It is a further objective of the present invention to provide an engine lubricant formulation.

It is yet another objective of the present invention to provide a fuel additive formulation containing a mixture of hexylene glycol and boric oxide.

It is a still further objective of the present invention to provide an engine lubricant formulation containing a mixture of hexylene glycol and boric oxide.

It is a further objective of the present invention to provide an engine additive fuel and/or internal combustion engine lubricant formulation containing a mixture of hexylene glycol and boric oxide which reduces wear in internal combustion engines running on hydrocarbon fuels.

It is a further objective of the present invention to provide a method of using a novel fuel additive containing a mixture of hexylene glycol and boric oxide.

It is a further objective of the present invention to provide a method of using a novel fuel engine lubricant containing a mixture of hexylene glycol and boric oxide.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

While the present invention is susceptible of embodiment in various forms, there is described a presently preferred, albeit not limiting, embodiment with the understanding that the present disclosure is to be considered an exemplification of the present invention and is not intended to limit the invention to the specific embodiments illustrated.

The present invention is a fuel based additive and/or engine lubricant containing antifriction and antiwear properties. The novel fuel additive and engine lubricant comprises hexylene glycol and boric oxide. The hexylene glycol/boric acid additive can be added to liquid hydrocarbon fuels, such as gasoline or diesel fuels, as well as petroleum-based and non-petroleum synthesized chemical compounds. The hexylene solution additive provides a delivery mechanism for boron compounds that protects and reduces friction and wear between metal surfaces in internal combustion engines. Accordingly, the novel fuel additive and engine lubricant increases engine performance and efficiency and reduces engine emissions, green house gases and other environmental pollutants. The novel fuel additive and engine lubricant solution may also contain additional components, including but not limited to a dispersant, such as polymeric dispersant designed for the wetting, dispersion and fluidization of solid particles in non-aqueous systems Hypermer™ LP-1 dispersant (Croda International) to slow down precipitation for solutions under thermal conditions.

Hexylene glycol, having the formula of $CH_3CH(OH)CH_2C(CH_3)_2OH$, and IUPAC name 2-methylpentane-2,4-diol is a member of the glycol family. While hexylene glycol has been used extensively in paints and cosmetics, use as a phase separator in ethanol-gasoline blends or as solvent for boric acid is not known. Several characteristic make it an ideal candidate for an environmentally friendly phase inhibitor in gasoline-ethanol blended fuels. It is a clear and odorless liquid at room temperature and has been determined to have low acute toxicity to mammals and aquatic organisms. It is fully miscible with water, ethanol, and gasoline and has less polarity than ethanol, allowing for better miscibility with gasoline as compared to ethanol. It is a viscous reducing agent and therefore will not increase the viscosity of the fuel. It is more hydroscopic than other common glycols. Other glycols are not known to be soluble in oil.

In a preferred embodiment of the present invention, the hexylene glycol additive solution further contains boric oxide ($B_2O_3$). Similar to boric acid, boric oxide ($B_2O_3$) is an environmentally safe compound which has been found to enhance anti-friction and anti-wear properties of sliding metals. Unlike boric acid, boric oxide does not contain water and contains approximately twice the amount of boron. In the present engine additive and/or engine lubricant formulation, hexylene glycol acts as a solvent for the boric oxide so that the solvent and the solute are homogeneously mixed. The additive solution contains hexylene glycol mixed with 0.1%-20% by weight boric oxide, and more preferably about 10% by weight boric oxide. One of the unique aspects of the hexylene glycol additive solution in accordance with the present invention is the fact that hexylene glycol acts as a solvent for the boric oxide allowing the formation of a liquid delivery system of boron. Such property allows the hexylene glycol additive solution to be formulated as a fuel additive to reduce fuel use and to extend the life of the moving metal parts of a vehicle engine, with double the amount of boron content and reduction of water content. Unlike other known boric oxide products used as engine lubricants, the hexylene glycol additive solution in accordance with the present invention is not an emulsion or suspension as the hexylene glycol acts as a solvent. Therefore, in contrast to known prior art engine lubricants that use boric oxide in the form of emulsions or suspensions subject to particle separation, the unique formulations in accordance with the present invention is not subject to particle separation.

Example of Hexylene Glycol Additive Solution as Fuel Additive: Anhydrous boric oxide, about 0.1-20%, and preferably 10%, was mixed with hexylene glycol at 150 degrees F., under high shear blending for approximately 15-30 minutes to form a hexylene glycol fuel additive solution. An appropriate amount of hexylene glycol additive solution is added directly to the fuel storage and/or the fuel delivery system of a moving vehicle containing a hydrocarbon fuels source such as gasoline or diesel fuel. Alternatively, the hexylene glycol additive solution may be mixed with the hydrocarbon fuel and delivered to the moving vehicle as a premixed fuel. In either case, the gasoline may additionally contain ethanol to form ethanol blended fuels, such as E10 or E85. If blended with a hydrocarbon such as gasoline, the hexylene glycol fuel additive solution may be used in a range of about 0.1% to 0.5%, preferably about 0.1%, or in a ratio of about 1:1000 hexylene glycol fuel additive:gasoline.

Example of Hexylene Glycol Additive Solution as an Engine Lubricant: As an illustrative example, about 0.1-20%, and preferably 10% anhydrous boric oxide powder is dissolved in hexylene glycol at 150 degrees F. and mixed under high shear blending for 15-30 minutes to form a hexylene glycol additive engine lubricant solution. The hexylene glycol additive engine lubricant solution can be combined with other components, such as petroleum-based and non-petroleum synthesized chemical compounds, including oils, such as motor oils (such as blended mixtures of hydrocarbons, polyalphaolefins, polyinternal olefins) and/or gear oils, or other hydrocarbon fuels, such as gasoline and/or diesel. The hexylene glycol additive engine lubricant solution can be added in an effective amount to act as a fuel lubricant. For example, when formulated with motor oils or gear oils, the hexylene glycol additive engine lubricant solution may be used in a range of 0.1% to about 20%, preferably 10%, or in a ratio of about 1:10 hexylene glycol additive:oil.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An engine additive fuel formulation consisting of a mixture of hexylene glycol and boric oxide.

2. The engine additive fuel formulation according to claim 1 wherein said boric oxide concentration is between 1% and 20% by weight.

3. The engine additive fuel formulation according to claim 2 wherein said boric oxide concentration is about 10% by weight.

4. An engine additive fuel formulation comprising a mixture of hexylene glycol, boric oxide, and a hydrocarbon fuel having at least 10% ethanol.

5. The engine additive fuel formulation according to claim 1 wherein said a hydrocarbon fuel is gasoline.

6. The engine additive fuel formulation according to claim 4 further including at least one petroleum-based or non-petroleum synthesized chemical compound.

7. The engine additive fuel formulation according to claim 6 wherein said petroleum-based or non-petroleum synthesized chemical compound is a motor oil or gear oil.

8. A method of reducing fuel use and lubricating one or more components of an engine comprising the steps of:

providing an engine additive fuel formulation consisting of a mixture of hexylene glycol and boric oxide, said engine additive fuel formulation formulated to enhance anti-friction and anti-wear properties; and delivering said engine additive fuel formulation to a vehicle having a fuel storage and delivery system.

9. The method of reducing fuel use and lubricating one or more components of an engine according to claim 8 wherein said boric oxide has a concentration of about 20% or less by weight.

10. The method of reducing fuel use and lubricating one or more components of an engine according to claim 8 wherein said boric oxide has a concentration of about 10% by weight.

11. A method of reducing fuel use and lubricating one or more components of an engine comprising the steps of:

providing an engine additive fuel formulation comprising a mixture of hexylene glycol, boric oxide, and an ethanol blended hydrocarbon having at least 10% ethanol; and delivering said engine additive fuel formulation to a vehicle having a fuel storage and delivery system.

12. The method of reducing fuel use and lubricating one or more components of an engine according to claim 11 wherein said boric oxide has a concentration of between 10% and 20%.

* * * * *